United States Patent [19]

Ginzburg

[11] Patent Number: 4,724,698

[45] Date of Patent: Feb. 16, 1988

[54] METHOD AND APPARATUS FOR ROLLING STRIP

[75] Inventor: Vladimir B. Ginzburg, Pittsburgh, Pa.

[73] Assignee: Wean United Rolling Mills, Inc., Pittsburgh, Pa.

[21] Appl. No.: 778,520

[22] Filed: Sep. 20, 1985

[51] Int. Cl.[4] ..... B21B 29/00; B21B 31/20

[52] U.S. Cl. ..... 72/243; 72/241

[58] Field of Search ..... 72/241, 243, 9, 12, 72/242, 245

[56] References Cited

U.S. PATENT DOCUMENTS

| | | | |
|---|---|---|---|
| 1,964,504 | 6/1934 | Coryell | 72/243 |
| 2,792,730 | 5/1957 | Cozzo | 72/241 |
| 2,909,088 | 10/1959 | Volkhausen | 72/241 |
| 3,724,252 | 4/1973 | Baker et al. | 72/241 |
| 4,059,976 | 11/1977 | Christ et al. | 72/19 |
| 4,269,051 | 5/1981 | Clarke et al. | 72/9 |

FOREIGN PATENT DOCUMENTS

| | | | |
|---|---|---|---|
| 17310 | 1/1982 | Japan | 72/243 |
| 106412 | 7/1982 | Japan | 72/243 |
| 915991 | 3/1982 | U.S.S.R. | 72/9 |

*Primary Examiner*—Robert L. Spruill
*Assistant Examiner*—Steve Katz
*Attorney, Agent, or Firm*—Arnold B. Silverman

[57] ABSTRACT

A mill stand having a pair of work rolls cooperating with at least one backup roll. Bending forces are applied to at least one work roll at or adjacent the ends thereof. The work rolls may be offset with respect to the backup rolls in either an upstream or downstream direction, and the bending forces may be applied in the direction of offset. The forces may be applied to both work rolls. An opposing force may be applied to the opposite side of the work rolls intermediate the bending forces applied to the work roll ends either through the strip tension differential or a direct application. A rolling mill stand having a pair of cooperating work rolls and cooperating backup rolls has a pair of first auxiliary rolls applying forces at or adjacent the ends of the work rolls. The work rolls may be offset and the bending forces are applied in the direction of offset. Second auxiliary rolls may be provided intermediate the first auxiliary rolls to provide an opposing force.

5 Claims, 4 Drawing Figures

METHOD AND APPARATUS FOR ROLLING STRIP

BACKGROUND OF THE INVENTION

1. Field of the Invention

This invention relates to an improved method and improved apparatus for rolling strip and, more specifically, relates to such methods and apparatus wherein undesired edge drop of the strip is resisted.

2. Description of the Prior Art

It is known that in the rolling of strips, the strip profile is impaired by the phenomena called "edge drop," which is primarily due to inherent bending of the ends of the rolls. This bending renders the strip more likely to have undesired "edge drop."

The "edge drop" or reduction in rolled material thickness in a lateral direction close to the edge, has proved troublesome. This defect is in part due to a combination of roll deflection and due in part to unrestrained edges of strip and the attenuated flattening of the work rolls at the strip-roll interface.

It has been known that "edge drop" can be decreased by shifting the rolls in a lateral direction in such a way that an additional deflection of the work rolls becomes possible near the edge of the strip. The problem with this approach is the need to provide sophisticated apparatus in order to accomplish both shifting and rotation of the rolls.

U.S. Pat. No. 4,059,976 discloses offsetting of work rolls in a downstream direction and the use of pressure compensating means to resist undesired work roll deflection.

U.S. Pat. No. 2,792,730 discloses the use of offset work rolls and a series of pressure controlled segmented rolls providing opposing forces. See also U.S. Pat. Nos. 1,964,504; 2,909,088 and 3,724,252.

In spite of the foregoing disclosures, there remains a real and substantial need for an effective means for resisting undesired edge drop.

SUMMARY OF THE INVENTION

The present invention has met the above described need by providing a method and apparatus which effectively serves to resist undesired edge drop.

The method of the present invention includes providing a mill stand having a pair of work rolls and a pair of cooperating backup rolls. The work rolls are offset with respect to the backup roll (when comparing the axis passing through the centers of the work rolls with the axis passing through the center of the backup rolls) in either an upstream or a downstream direction. Bending forces are applied to at least one of the work rolls at or adjacent the ends of the roll in the direction of the offset. The bending forces may be applied to both work rolls.

An opposing force may be applied to one or both work rolls either through the strip being subjected to tension or through an additional roll located generally at the center of the work roll or both. This roll bending will result in additional opening of the roll gap near the strip edges which will reduce the edge drop.

The apparatus of the present invention involves a rolling mill stand having a pair of work rolls cooperating with a pair of backup rolls with the work rolls being offset either downstream or upstream with respect to the backup rolls. First auxiliary rolls apply bending forces at or adjacent the ends of one or both work rolls and second auxiliary rolls may be employed to provide opposing forces intermediate the first auxiliary rolls. In a preferred embodiment, the first auxiliary rolls are disposed beyond the lateral edges of the strip and second auxiliary rolls will be disposed generally in the center of the work rolls.

It is an object of the present invention to provide a method and apparatus for effectively reducing undesired edge drop in strip being rolled.

It is a further object of the present invention to provide such a method and apparatus which is economical to employ and is compatible with the existing rolling mill technology.

It is a further object of the present invention to reduce edge drop by offsetting the work rolls in either a downstream or upstream direction and applying bending forces locally or adjacent the end of one or both rolls.

These and other objects of the invention will be more fully understood from the following description of the invention on reference to the illustrations appended hereto.

DESCRIPTION OF THE PREFERRED EMBODIMENTS

Figure 1:
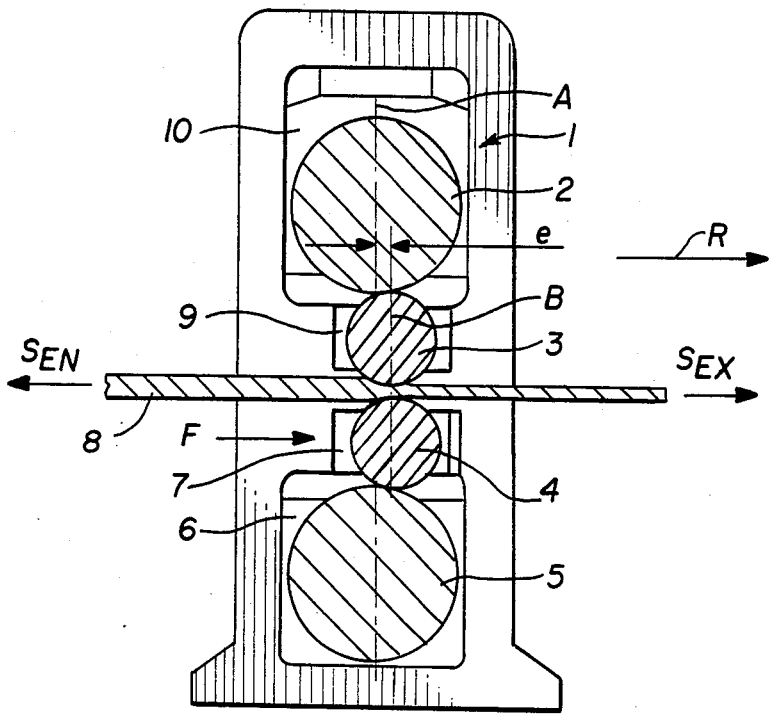
FIG. 1 is a schematic cross sectional illustration of an embodiment of the invention showing a four-high mill stand.
Figure 2:
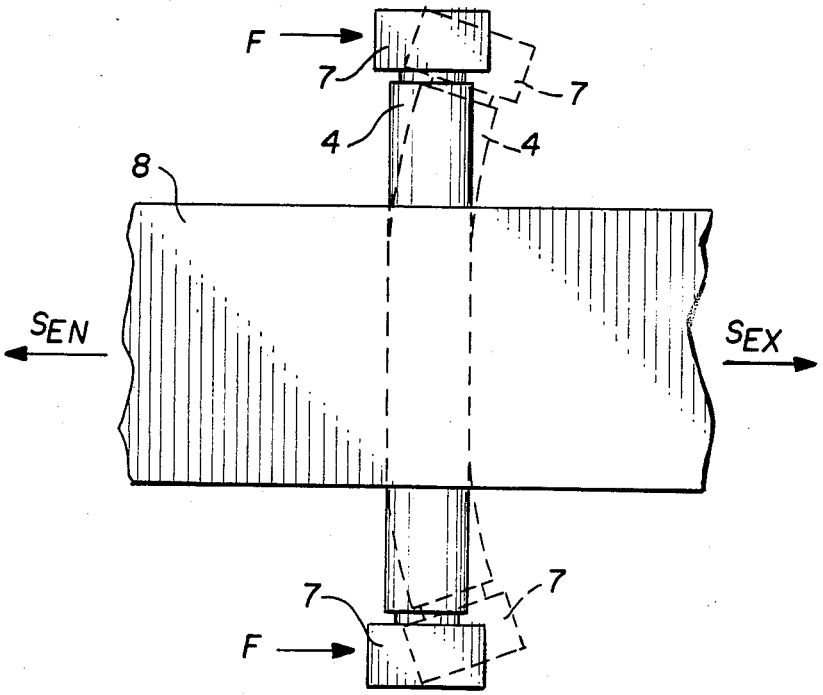
FIG. 2 is a top plan view of a stand of the type shown in FIG. 1.

Referring to FIGS. 1 and 2, a housing 1 of a four-high mill stand secures an upper backup roll 2 which is operatively associated with an upper work roll 3 and is in surface-to-surface contact therewith. Similarly, a lower work roll 4 is operatively associated with a lower backup roll 5. All of the rolls are suitably journalled in chucks. The bottom backup roll has a pair of chucks 6. The bottom work roll has a pair of chucks 7, the top work roll has a pair of chucks 9 and the top backup roll has a pair of chucks 10. The strip 8 in the form illustrated is being rolled in the direction indicated by the arrow R. The upstream or entry strip tension has been indicated by the arrow $S_{EN}$ and the exit or downstream strip tension has been indicated by the arrow labeled $S_{EX}$.

As is shown clearly in FIG. 1, the axis A passing through the centerlines of backup rolls 2, 5 is offset from the axis B which passes through the center lines of work rolls 3, 4. The work rolls 3, 4 are offset by a dimension e in a downstream direction with respect to the backup rolls in the form shown. This dimension e is preferably about 0.10 to 0.25 inch. In the present invention, the offset of the work rolls 3, 4 with respect to the backup rolls 2, 5 may be effected either in the downstream direction as is shown in FIGS. 1 and 2 or in the upstream direction.

By forces F applied at or adjacent to the ends of the rolls or to the chucks in the direction in which the work rolls are offset with respect to the backup rolls, the work rolls will be bent and, therefore, the roll gap near the strip edges will be increased. This would reduce the edge drop. The dotted representation of the work roll 4 and chucks 7 in FIG. 2 shows the bending which would occur due to the application of forces F. For example, for the mill with a work roll of 21 inches in diameter and 80 inches in length, and backup roll of 60 inches in diameter, the force F=250,000 pounds will result in a roll gap opening of 0.010 inches near the work roll edge.

The forces may be applied by any convenient known means such as the use of hydraulic cylinders, for example.

It is also contemplated that an opposing force will be applied generally toward the center of the work roll in a direction opposed to the bending forces. In the embodiment of FIG. 2 such opposing force would be equal to ($S_{EN}-S_{EX}$) which is the difference between entry and exit strip tension, assuming that $S_{EN}$ is greater than $S_{EX}$. The tension differential must be such that the tension on the opposite side of the backup roll centerline from the direction of work roll offset is greater than the other tension. Thus in FIG. 2, $S_{EN}$ is greater than $S_{EX}$. Were the work roll offset in the upstream direction, $S_{EX}$ should be greater than $S_{EN}$.

In general, it is preferred that at least one of the work rolls be provided with this force system. It may be advantageous in many instances to provide these forces to both work rolls.

Figure 3:
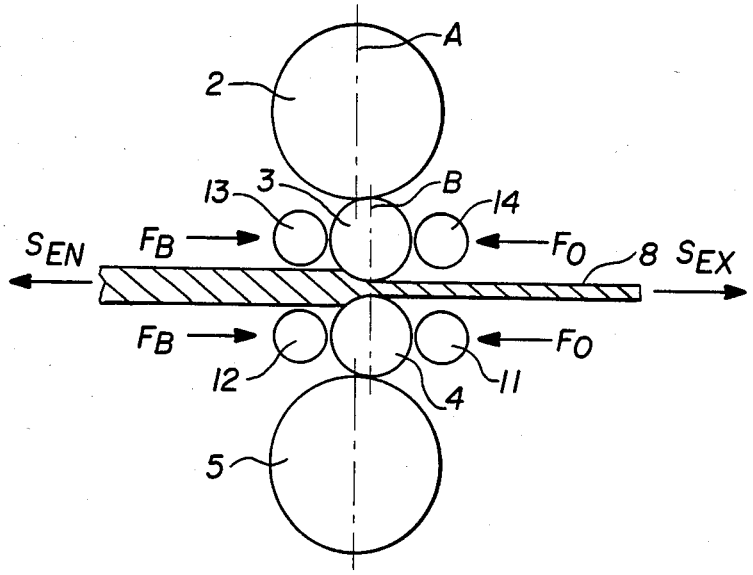
FIG. 3 is a schematic elevational view of a modified embodiment of the present invention.
Figure 4:
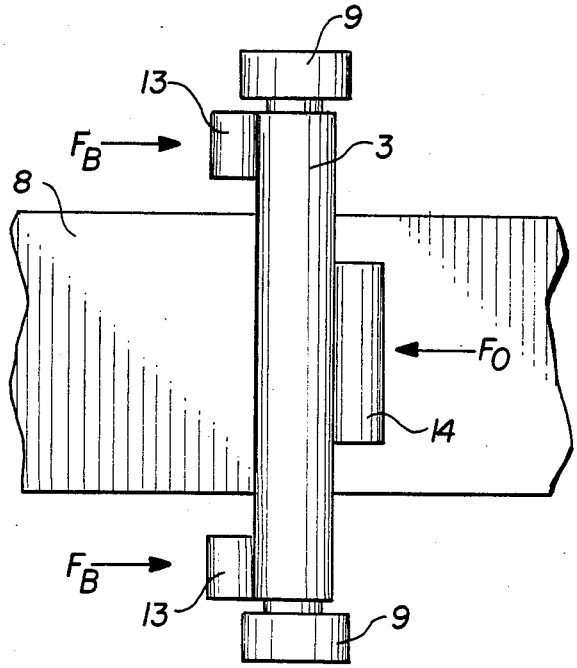
FIG. 4 is a top plan view of the apparatus of FIG. 3.

Referring to FIGS. 3 and 4, a refinement of the invention will be considered. In this embodiment, auxiliary work rolls 13 are positioned adjacent the ends of the work rolls to apply the bending forces. As is shown, these rolls 13 are preferably disposed laterally outwardly from the edges of strip 8. An opposing force $F_0$ is provided by roll 14 which is in contact generally with the center of work roll 3. The opposing force roll 14 is confined within the lateral edges of the strip 8.

In the form shown, rolls 13, 14 are employed with both work rolls 3, 4 respectively.

In the preferred form, the auxiliary or bending rolls 12, 13 will have generally the same diameter as the opposing second auxiliary rolls 11, 14 and will have a length of about 10 to 25 percent of the length of the work rolls. In this embodiment it is not essential that the work rolls be offset.

It will be appreciated, therefore, that the present invention provides an effective means for resisting undesired edge drop by the application of bending forces to one are both work rolls and the application of corresponding opposing forces to one or both work rolls with or without work roll offset.

While for convenience of reference herein an example showing a four-high mill has been provided, it will be appreciated that the invention is not so limited. For general, it may be employed in three-high or higher mills.

While a single stand has been shown, it will be appreciated that the invention may be employed with tandem mills.

Whereas particular embodiments of the invention have been described above for purposes of illustration, it will be evident to those skilled in the art that numerous variations of the details can be made without departing from the invention as defined in the appended claims.

I claim:

1. A rolling stand having a cooperative pair of work rolls rotatably received in and supported by a housing for reducing a metal strip passed therethrough from an upstream side to a downstream side thereof, comprising:

said work rolls having a bearing clock assemblies mounted on their opposite ends, a backup roll for each work roll engageable therewith on the side of the work roll opposite the strip side thereof, the axes of the work rolls being located generally in a first vertical plane and the axes of the backup rolls being generally located in a second vertical plane, wherein said first vertical plane is offset with respect to said second vertical plane in a direction towards the downstream or upstream side of the stand, the axial lengths of the work rolls being greater than the maximum width of the strip to be rolled by the stand and having axial portions on their opposite ends inward of said bearing chock assembly and outward of said maximum width strip, first force applying located on a first side relative to the axes of said rolls, and arranged to engage and apply a force to only each said axial portions of said work rolls to cause the ends of the work rolls to be subject to a controlled deflection in the direction of said offset, and second force applying means for each work roll located on a second side relative to the axes of said rolls opposite to said first force applying means and arranged to engage and apply a force to only a central portion of each work roll in a direction generally opposite to said first force to augment said controlled deflection, thereby to lessen the edge drop effect on the strip during rolling thereof.

2. A rolling mill stand according to claim 1 wherein said first and second force applying means each include rotatable rolling means arranged to engage the work rolls for applying said forces thereto.

3. A rolling mill stand according to claim 2 wherein each said first force applying means has an axial extent of about 10 to 25 percent of the length of a said work roll.

4. A method of rolling metal strip while lessening edge drop effect comprising providing a rolling mill stand having a cooperative pair of work rolls each having a bearing chock assemblies mounted on their opposite ends and rotatably received in and supported by a housing for reducing a metal strip passed therethrough from an upstream side to a downstream side thereof, providing said each work roll with an axial length being greater than the maximum width of strip to be rolled by the stand and having axial portions on their opposite ends inward of said bearing chock assembly and outward of said maximum width strip, providing a backup roll for each work roll engaged therewith opposite the strip side of said work roll with the axes of the work rolls being disposed generally in a first vertical plane and the axes of the backup rolls being disposed in a second vertical plane, offsetting said first plane from said second plane, applying first forces from a first side relative to said axes of said rolls generally in the direction of said offset to only said axial portions of said work rolls inwardly of said bearing chock assembly and outwardly of both sides of said strip, and applying second forces from a second side relative to the axes of said work rolls opposite from where said first forces are applied in a direction generally opposite to said first forces to only the central portions of said work rolls.

5. The method of rolling strip of claim 4 including applying said first and second forces by rotatable rolling means in engagement with said work rolls.

* * * * *

UNITED STATES PATENT AND TRADEMARK OFFICE

CERTIFICATE OF CORRECTION

PATENT NO. : 4,724,698

DATED : February 16, 1988

INVENTOR(S) : VLADIMIR B. GINZBURG

It is certified that error appears in the above-identified patent and that said Letters Patent is hereby corrected as shown below: On The Title Page:

In the Abstract, before the first line, insert --A method of rolling strip includes providing--.

Column 3, line 45, "are" should be --or--.

Claim 1, column 3, line 67, "a" should be deleted, and "clock" should be --chock--.

Claim 1, column 4, line 15, --means-- should be inserted after "applying".

Claim 4, column 4, line 38, "a" should be deleted.

Signed and Sealed this

Twenty-second Day of November, 1988

*Attest:*

DONALD J. QUIGG

*Attesting Officer*

*Commissioner of Patents and Trademarks*